US005631689A

United States Patent [19]

Izumi

[11] Patent Number: 5,631,689

[45] Date of Patent: May 20, 1997

[54] CONTROLLING METHOD FOR HEAT OF THERMAL HEAD

[75] Inventor: Hiroshi Izumi, Morioka, Japan

[73] Assignee: Alps Electric Co., Ltd., Tokyo, Japan

[21] Appl. No.: 582,040

[22] Filed: Dec. 27, 1995

Related U.S. Application Data

[63] Continuation of Ser. No. 938,788, Sep. 1, 1992, abandoned.

[30] Foreign Application Priority Data

Sep. 6, 1991 [JP] Japan ..... 3-227312

[51] Int. Cl.[6] ..... B61J 2/355

[52] U.S. Cl. ..... 347/211; 347/180

[58] Field of Search ..... 347/188, 183, 347/211, 180; 400/120.09, 120.07

[56] References Cited

U.S. PATENT DOCUMENTS 4,816,843 3/1989 Sasaki ..... 346/76 PH

*Primary Examiner*—Huan H. Tran

*Attorney, Agent, or Firm*—Guy W. Shoup; Patrick T. Bever

[57] ABSTRACT

A method for controlling heat generated by the heat-generating elements of a thermal head, the elements being successively actuated to heat the thermal head in response to an electrical current which is applied to each of the plurality elements from a control circuit for a power-on time which is n times a minimum time period. The method includes determining a calculated power-on time for a selected element and assigning the power-on time for the selected element one of: a value equal to the calculated power-on time if the calculated power-on time is equal to n times the minimum time period; a value equal to the calculated power-on time, rounded up to a nearest multiple of the minimum time period, if the calculated power-on time is not equal to n times the minimum time period, and if the selected element is an even-numbered one of said plurality of elements; and an actual power-on time equal to the calculated power-on time, rounded down to a nearest multiple of the minimum time period, if the calculated power-on time is not equal to n times the minimum time period, and if the selected element is an odd-numbered one of said plurality of elements.

7 Claims, 4 Drawing Sheets

CONTROLLING METHOD FOR HEAT OF THERMAL HEAD

This application is a continuation of application Ser. No. 07/938,788, now abandoned filed Sep. 1, 1992.

BACKGROUND OF THE INVENTION

1. Field of the Invention

This invention relates to a method for controlling heat of a thermal head in a thermal printer for carrying out a printing on a recording medium such as form, film or the like, and is particularly concerned with a method for controlling heat of a thermal head for which a heat generated state is properly controlled to produce a better quality printing.

2. Description of the Prior Art

Generally, a thermal head is formed to have a plurality of heat-generating elements arrayed in a single or plural row on a metallic or ceramic substrate, and a printing operation is performed by actuating each heat-generating element by applying a current selectively thereto according to printing information.

The thermal head brings about a temperature rise on each heat-generating element and substrate at the time of printing, therefore in consideration of the temperature rise, an arrangement is such that a power-on time to each heat-generating element is adjusted to prevent an uneven printing from resulting.

For the correction, a past record correcting method and an area correcting method were employed.

The past record correcting method comprises correcting a power-on time in accordance with a past power-on state of the heat-generating element to which to carry a current and its neighboring heat-generating elements.

On the other hand, temperature of the substrate gradually rises from carrying a current to the heat-generating element, therefore if correction is not applied there may arise a difference in print density between the beginning and the end of a line, and hence the power-on time will be corrected therefor in the area correcting method.

A power-on time $T_{on}$ for the area correction is controlled by a drive circuit wherein, as shown in FIG. 2, a control command is written by turns in a plurality of latches connected to a data bus, thereby outputting a power to each heat-generating element. For obtaining output to 48 dots (48 heat-generating elements) by means, for example, of an 8-bit latch, six latches will be used. Further, a control of the power-on time by the drive circuit is effected according to the control command written in each latch from accessing by turns to the plurality of latches through the data bus, therefore the power-on time to each heat-generating element cannot be controlled by a resolution finer than a minimum power-on time $T_{res}$ (resolution) expressed by the product TN of a time T for accessing one latch and a number N of the latches, and hence the power-on time to each heat-generating element is controlled by means of a value given integral times as high as the minimum power-on time ($T_{res}$ ×n).

However, in the prior art controlling method for heat of a thermal head described as above, since a power-on time to each heat-generating element is controlled by means of the minimum power-on time multiplied integrally, a problem inherent therein is such that a fine control of the power-on time for securing a quality print is no more realizable for the recent high-speed requirement of printing, a multiplicity of the heat-generating elements (characters more than 48 dots being used generally on the latest thermal printer) and so forth.

Additionally, a size of each heat-generating element is 0.1 mm or below, and hence when the power-on time to each heat-generating element is to be controlled minutely, a drive circuit complicate in construction must be used, a big-sized system is entailed all the more and a cost increases inevitably as well.

SUMMARY OF THE INVENTION

This invention has been done in view of the problems mentioned above, and its object is to provide a method for controlling heat of a thermal head wherein the aforementioned problems inherent in the prior art system are overcome, a power-on time to each heat-generating element can be controlled more minutely without complicating a construction of the drive circuit as ever before, a uniform and quality print is obtainable despite a high-speed requirement of printing and multiplicity of the heat-generating elements.

Another object of this invention refers to a controlling method for, controlling the quantity of heat generated on the thermal head by correcting a power-on time to each heat-generating element of the thermal head with a plurality of heat-generating elements arrayed on a substrate, thereby printing characters on a recording medium, which is characterized in that the power-on time to each heat-generating element is calculated on a time smaller than a minimum power-on time, and where the calculated power-on time to each heat-generating element is integral times as high as the minimum power-on time, a current is carried to each heat-generating element exactly for the calculated power-on time, but where the calculated power-on time to each heat-generating element is different from the value integral times as high as the minimum power-on time, whether a printing place of the heat-generating element in the column direction is an odd-number place or an even-number place is decided, the power-on time in each place is given by an integral value obtained from carrying up fractions below a decimal point of the calculated power-on time in either one of the places and by an integral value obtained from rounding down fractions below a decimal point of the calculated power-on time in the other place.

According to the controlling method constructed as above, a power-on time to each heat-generating element is calculated on a time smaller than a minimum power-on time, and if the calculated power-on time to each heat-generating element is integral times as high as the minimum power-on time, a current is carried to each heat-generating element exactly for the calculated power-on time, but if the calculated power-on time to each heat-generating element is different from the value integral times as high as the minimum power-on time, whether a printing place of the heat-generating element in the column direction is an odd-number place or an even-number place is decided, the power-on time in each place is given by an integral value obtained from carrying up fractions below a decimal point of the calculated power-on time in either one of the places and by an integral value obtained from rounding down fractions below a decimal point of the calculated power-on time in the other place, thereby obtaining apparently a print quality by a power-on time more minutely than the minimum power-on time.

DETAILED DESCRIPTION OF THE PREFERRED EMBODIMENTS

Preferred embodiments of this invention will now be described with reference to FIG. 1 to FIG. 4. In this connection, a thermal head with 48 heat-generating elements disposed in one row is subjected to control in the embodiments.

Figure 1:
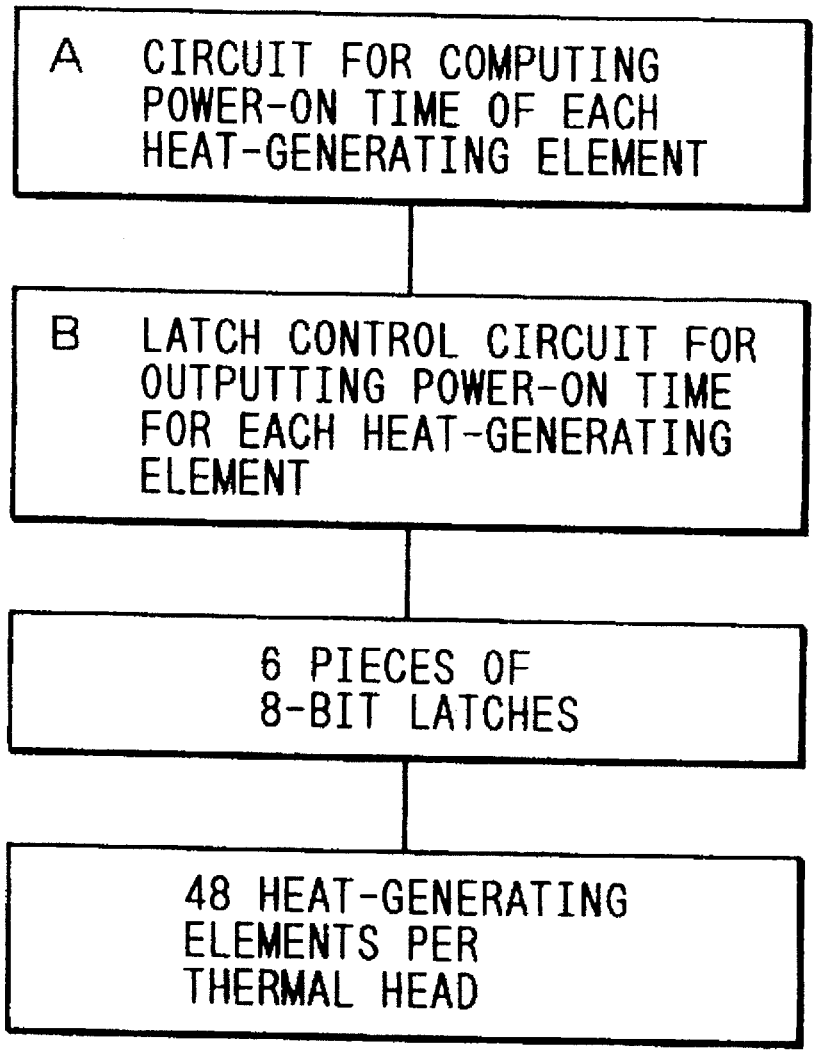
FIG. 1. is a block diagram representing a hardware configuration which realizes a method for controlling heat of a thermal head according to this invention.
Figure 2:
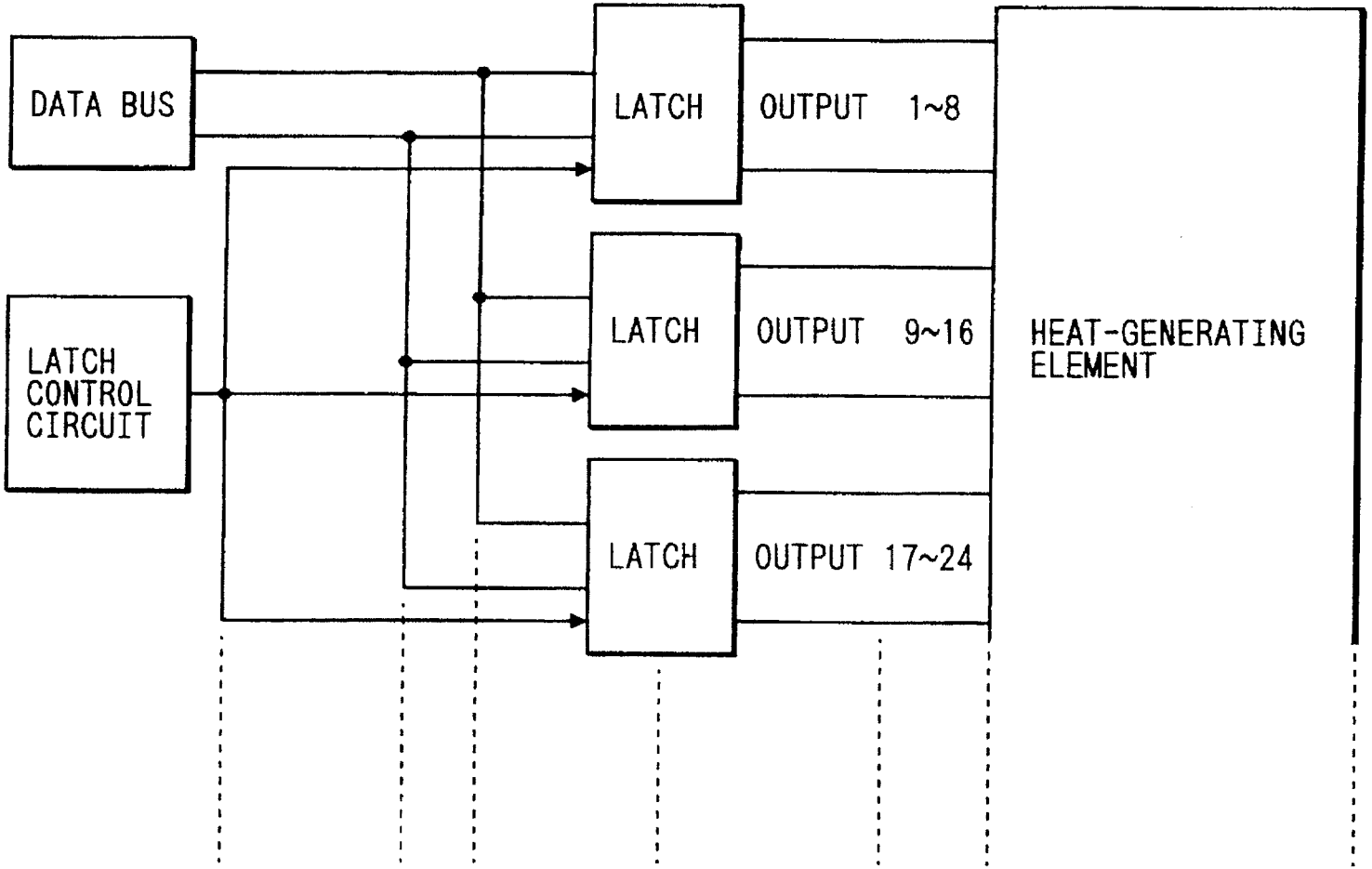
FIG. 2 is a block diagram representing a circuit configuration to which the method of this invention is applied.
Figure 3:
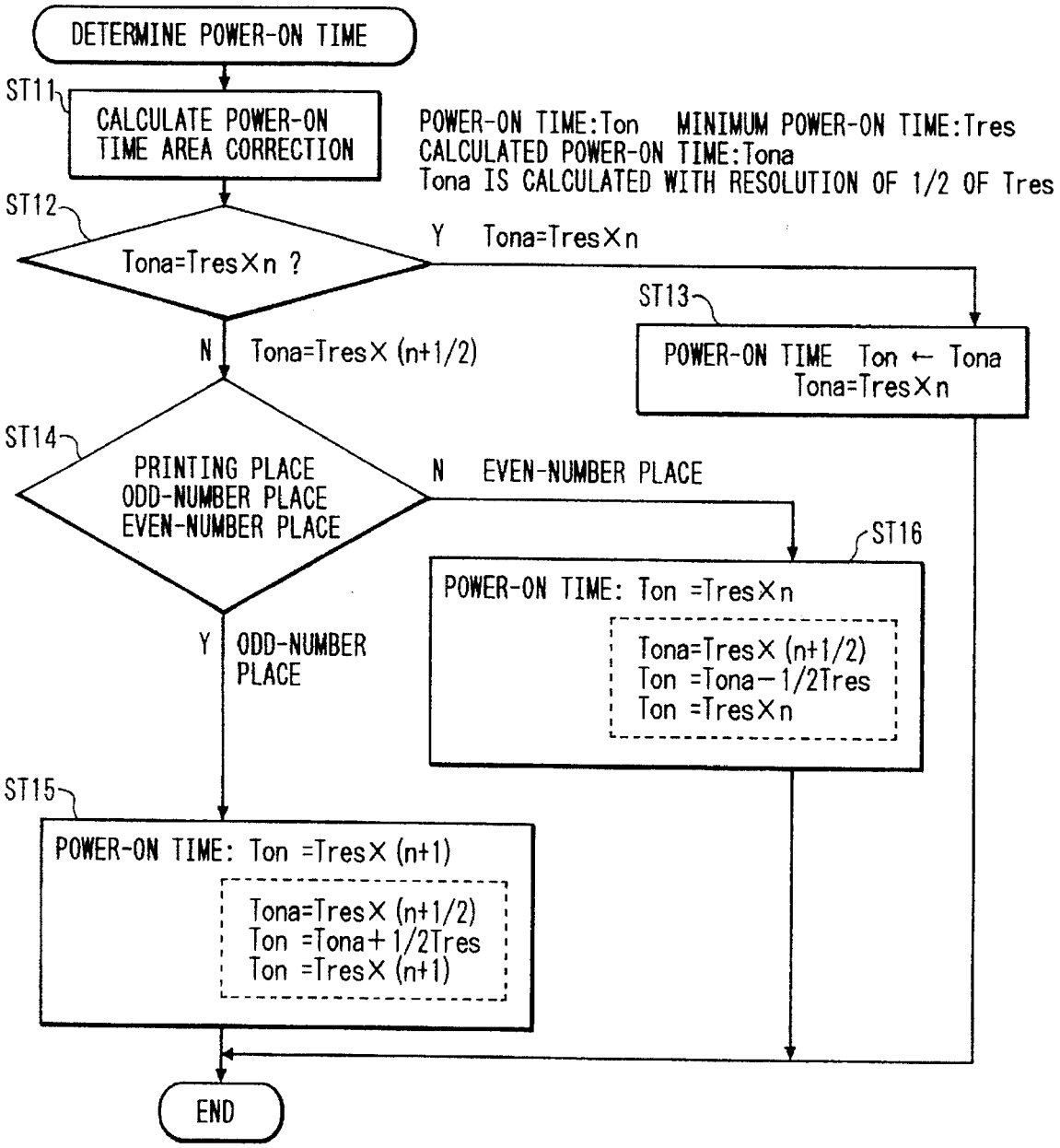
FIG. 3 is a flowchart for determining a power-on time to heat-generating elements of a thermal head given in a first embodiment of this invention.

FIG. 1 is a block diagram representing a hardware configuration of a thermal head to which a controlling method for heat of a thermal head relating to this invention is applied, FIG. 2 is a block diagram representing a circuit configuration, and FIG. 3 is a flowchart for determining a power-on time to heat-generating elements of the thermal head.

As illustrated in FIG. 1, a hardware configuration of the thermal head to which the method according to this invention is applied comes in a circuit A for calculating a power-on time $T_{on}$ at every heat-generating element, a latch control circuit B for outputting the power-on time at every heat-generating element, an 8-bit latch in 6 pieces, and a thermal head with 48 heat-generating elements disposed in one row.

Further, as shown in FIG. 2, a circuit configuration of the hardware is such that control commands based on a calculation result of the circuit A operating for calculation of the power-on time at every heat-generating element are accessed by turns to each latch through a data bus to writing therein, and an electric power is outputted in latch units to each heat-generating element for a desired power-on time from each latch controlled by the latch control circuit. Then, as mentioned hereinbefore, a control of the power-on time according to such circuit configuration is effected on control commands written in each latch by accessing by turns to the plurality of latches through the data bus, therefore the power-on time to each heat-generating element is controlled with a minimum power-on time $T_{res}$ (resolution) expressed by the product TN of a time T for accessing one latch and a number N of the latches as a minimum unit.

Described next is a method for determining the power-on time to each heat-generating element of the thermal head according to this embodiment with reference to FIG. 3.

First, in step ST11, an area correction time for all the heat-generating elements is calculated, and a calculated power-on time $T_{ona}$ is obtained in a precision of ½ of the minimum power-on time (resolution) $T_{res}$.

Next, in step ST12, whether or not the calculated power-on time $T_{ona}$ is integral times as high as the minimum power-on $T_{res}$ is decided, and if YES ($T_{ona}=T_{res}\times n$), the calculated power-on time $T_{ona}$ is chosen as the power-on time $T_{on}$, but if NO $\{T_{ona}=T^{res}\times(n+½)\}$, the flow proceeds to next step ST14.

In step ST14, whether a printing place of the print position is odd-number place or even-number place is decided according to printing information with reference to the print position in the column direction included in the printing information, and if YES (odd-number place), the flow proceeds to step ST15, where the power-on time $T_{on}$ is obtained from adding ½ of the minimum power-on time $T_{res}$ to the calculated power-on time $T_{ona}$, but if NO (even-number place), then the flow proceeds to step ST16, where the power-on time $T_{on}$ is obtained from subtracting ½ of the minimum power-on time $T_{res}$ from the calculated power-on time $T_{ona}$.

An operation of the embodiment constructed as above will be described next.

In this embodiment, the arrangement is such that the power-on time $T_{ona}$ is calculated in the unit of ½ of the minimum power-on time $T_{res}$, and when the calculated power-on time $T_{ona}$ results in indicating a value integral times as high as the minimum power-on time $T_{res}$, the calculated power-on time $T_{ona}$ is decided to be the power-on time $T_{on}$, but when the calculated power-on time $T_{ona}$ is different from the value integral times as high as the minimum power-on time $T_{res}$, whether the printing place of a print position is odd-number place or even-number place is decided, and if the odd-number place, the power-on time $T_{on}$ is obtained from adding ½ of the minimum power-on time $T_{res}$ to the calculated power-on time $T_{ona}$, but if the even-number place, then the power-on time $T_{on}$ is obtained from subtracting ½ of the minimum power-on time $T_{res}$ from the calculated power-on time $T_{ona}$, thereby varying the power-on time $T_{on}$ according to the printing place despite the calculated power-on time $T_{ona}$ being identical.

The calculated power-on time and the power-on time are exemplified in TABLE 1.

TABLE 1

| | Calculated Power-on Time and Power-on Time (Unit: Min. power-on time Tres = 1) | | | | | | | |
|---|---|---|---|---|---|---|---|---|
| | Printing place<br>Print position in the column direction | | | | | | | |
| Item | 1<br>Odd-number place | 2<br>Even-number place | 3<br>Odd-number place | 4<br>Even-number place | 5<br>Odd-number place | 6<br>Even-number place | 7<br>Odd-number place | 8<br>Even-number place |
| Calculated power-on time Tona | 2.5 | 2.5 | 2.0 | 2.5 | 2.5 | 2.0 | 2.5 | 2.5 |
| Power-on time Ton | 3 | 2 | 2 | 2 | 3 | 2 | 3 | 2 |

As will be apparent from TABLE 1, the calculated power-on time $T_{ona}$ is 2.5 of the minimum power-on time $T_{res}$, but this value is different from that integral times as high as the minimum power-on time $T_{res}$ and the print position comes on an odd-number place, therefore the power-on time $T_{on}$ on the first column in the direction of printing place takes a value 3 obtained from adding ½ of the minimum power-on time $T_{res}$ to the calculated power-on time $T_{ona}$ being 2.5. Further, the calculated power-on time $T_{ona}$ is 2.5 of the minimum power-on time $T_{res}$, but this value is different from that integral times as high as the minimum power-on time $T_{res}$ and the print position comes on an even-number place, therefore the power-on time $T_{on}$ on the second column in the direction of printing place takes a value 2 obtained from subtracting ½ of the minimum power-on time $T_{res}$ from the calculated power-on time $T_{ona}$ being 2.5. Still further, the calculated power-on time $T_{ona}$ is 2.0 of the minimum power-on time $T_{res}$, but this value coincides with that integral times as high as the minimum power-on time $T_{res}$, therefore the power-on time $T_{on}$ on the third column in the direction of printing place becomes 2 identical with that of the calculated power-on time $T_{ona}$ irrespective of odd-number place and even-number place of the print position.

Thus, the print quality according to the controlling method for heat of a thermal head of this invention is ensured likewise apparently as in the case where printing is effected by controlling the power-on time $T_{on}$ in the unit of ½ of the minimum power-on time $T_{res}$ to each heat-generating element, and a precision (resolution) of the minimum power-on time $T_{res}$ of the controllable power-on time $T_{on}$ can be improved double.

Further, the number of heat-generating elements to which the method according to this invention is applied may be more than one, and hence it is not necessarily limited to the number specified in this embodiment, and thus, needless to say, the method is applicable to a multiplicity of heat-generating elements such as, for example, 64 pieces, 166 pieces, 1,024 pieces and so forth.

Figure 4:
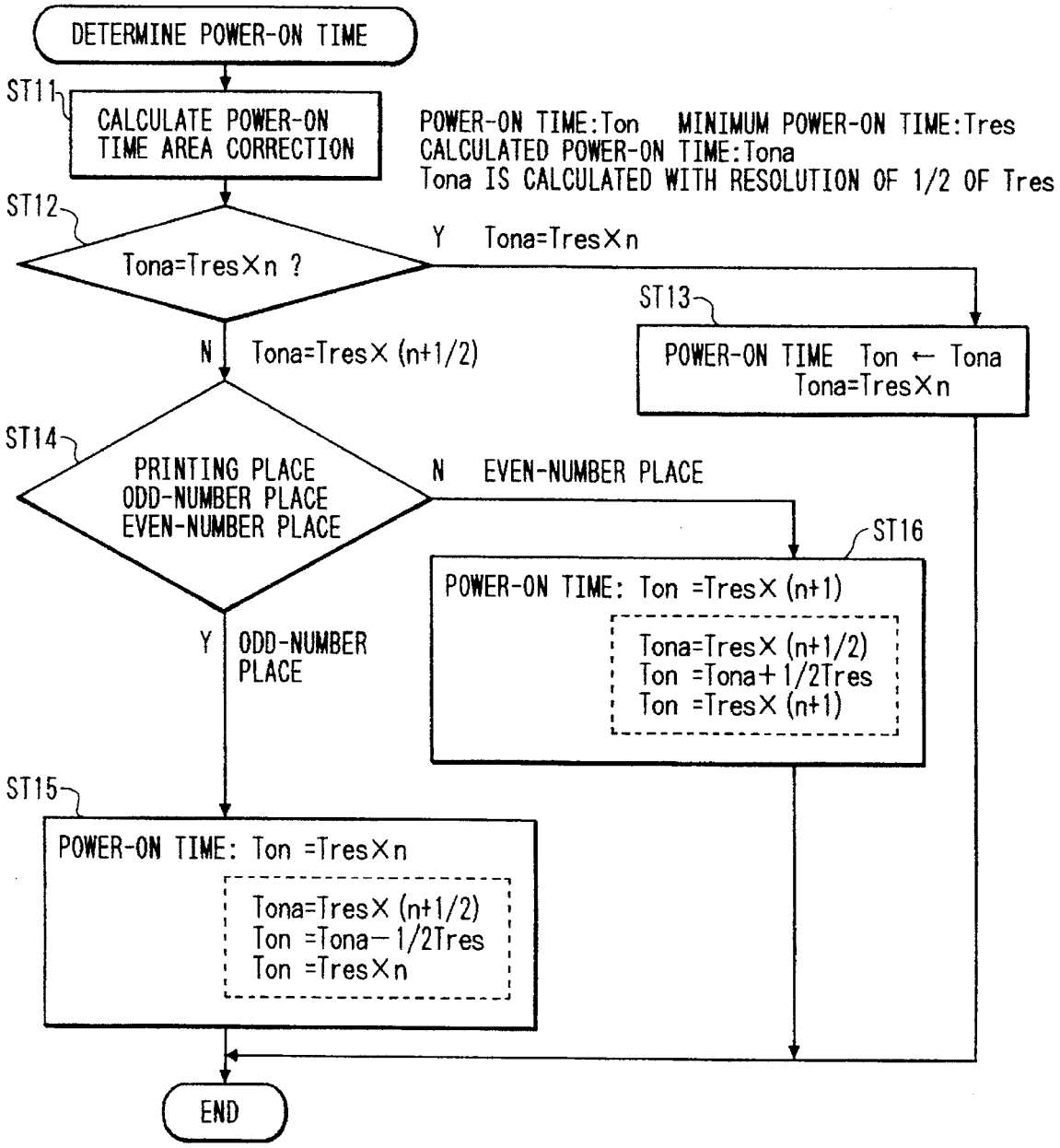
FIG. 4 is a flowchart representing a second embodiment to which the method according to this invention is applied.

FIG. 4 is a flowchart for determining a power-on time to heat-generating elements of a thermal head given in a second embodiment to which the controlling method for heat of a thermal head relating to this invention is applied, and in this embodiment, the construction is such that where the calculated power-on time $T_{ona}$ is different from that integral times as high as the minimum power-on time $T_{res}$, the power-on time $T_{on}$ is obtained from subtracting ½ of the minimum power-on time $T_{res}$ from the calculated power-on time $T_{ona}$ when the printing place of a print position is an odd-number place, and the power-on time $T_{on}$ is obtained from adding ½ of the minimum power-on time $T_{res}$ to the calculated power-on time $T_{ona}$ when the printing place of a print position is an even-number place. Then, since the other construction is similar to the first embodiment described hereinabove, a further description will be omitted here.

According to such construction, an advantage similar to the first embodiment may be realized.

Further, this invention is not necessarily limited to the embodiments mentioned above, and hence may be modified as occasion demands. For example, the invention is applicable to a control of the power-on time in the direction of row of the heat-generating elements.

As described above, according to this invention, the power-on time can be changed according to printing places despite the calculated power-on time being identical. That is, a print quality according to such method for controlling heat of a thermal head is capable of enhancing and also substantially unifying apparently a precision (resolution) of the minimum power-on time of a controllable power-on time, therefore the power-on time to heat-generating elements can be controlled minutely for obtaining a quality printing to cope with a high-speed requirement of printing and a multiplicity of the heat-generating elements in number, and an advantage exceedingly prominent in economical need may be realized such that a large-sized construction of a system and a complication of a circuit configuration can securely be prevented.

What is claimed is:

1. A method for controlling an amount of heat generated by a thermal head device, the thermal head device including:

a thermal head having a plurality of heat-generating elements arranged in a row, successive elements of the plurality of heat-generating elements being alternately designated as an odd-number element and an even-number element;

a calculation circuit for generating a power-on time for each heat-generating element of said thermal head;

a plurality of latches, each of the plurality of latches being connected to an associated group of the plurality of heat-generating elements; and a control circuit for controlling said plurality of latches such that each of the plurality of latches applies power to selected elements of the associated group of heat-generating elements for a duration equal the power-on time output from the calculation circuit wherein said method comprises the steps of:

(a) calculating a power-on time for a selected element of the plurality of heat-generating elements in units of time shorter than a minimum power-on time, the selected element being connected to a first latch of the plurality of latches;

(b) determining whether the calculated power-on time is equal to an integral multiple of the minimum power-on time or not;

(c) if the calculated power-on time is equal to such an integral multiple:

(i) writing the calculated power-on time directly to said first, latch as the power-on time for said selected element, and (ii) applying electrical current to the selected element via said first latch for a period equal to said power-on time; and (d) if the calculated power-on time is not equal to such an integral multiple:

(i) determining whether the selected element is an odd-number element or an even-number element;

(ii) changing the calculated power-on time for the selected element to an integral value obtained by rounding up fractions below a decimal point of the calculated power-on time if the selected element is a first one of an odd-numbered element and an even-number element, and to an integral value obtained by rounding down fractions below a decimal point of the calculated power-on time if the selected element is a second one of an odd-number element and an even-number element;

(iii) writing the changed calculated power-on time directly to said first latch as the power-on time for said selected element; and (iv) applying electrical current to the selected element via said first latch for a period equal to said power-on time.

2. The method of claim 1, wherein the step of calculating the calculated power-on time includes rounding the calculated power-on time to nearest ½ times the minimum power-on time.

3. A method for controlling an amount of heat generated by a thermal head device the thermal head device including:

a thermal head having a plurality of heat-generating elements arranged in a row, successive elements of the plurality of heat-generating elements being alternately designated as an odd-number element and an even-number element;

a calculation circuit for generating a power-on time for each heat-generating element of said thermal head;

a plurality of latches, each of the plurality of latches being connected to an associated group of the plurality of heat-generating elements; and a control circuit for controlling said plurality of latches such that each of the plurality of latches applies power to selected elements of the associated group of heat-generating elements for a duration equal the power-on time output from the calculation circuit, wherein said method comprises the steps of:

(a) calculating a power-on time for a selected element of the plurality of heat-generating elements in units of time shorter than a minimum power-on time, the selected element being connected to a first latch of the plurality of latches;

(b) determining whether the calculated power-on time is equal to an integral multiple of the minimum power-on time or not;

(c) if the calculated power-on time is equal to such an integral multiple:

(i) writing the calculated power-on time directly to said first latch as the power-on time for said selected element, and (ii) applying electrical current to the selected element via said first latch for a period equal to said power-on time; and (d) if the calculated power-on time is not equal to such an integral multiple:

(i) determining whether the selected element is an odd-number element or an even-number element;

(ii) changing the calculated power-on time for the selected element to an integral value obtained by rounding up fractions below a decimal point of the calculated power-on time if the selected element is an odd-number element, and to an integral value obtained by rounding down fractions below a decimal point of the calculated power-on time if the selected element is an even-number element;

(iii) writing the changed calculated power-on time directly to said first latch as the power-on time for said selected element; and (iv) applying electrical current to the selected element via said first latch for a period equal to said power-on time.

4. A controlling method according to claim 3, wherein the power-on time is calculated in power-on time units corresponding to half the minimum power-on time.

5. A method for controlling an amount of heat generated by a thermal head device, the thermal head device including:

a thermal head having a plurality of heat-generating elements arranged in a row, successive elements of the plurality of heat-generating elements being alternately designated as an odd-number element and an even-number element;

a calculation circuit for generating a power-on time for each heat-generating element of said thermal head;

a plurality of latches, each of the plurality of latches being connected to an associated group of the plurality of heat-generating elements; and a control circuit for controlling said plurality of latches such that each of the plurality of latches applies power to selected elements of the associated group of heat-generating elements for a duration equal the power-on time output from the calculation circuit, wherein said method comprises the steps of:

(a) calculating a power-on time for a selected element of the plurality of heat-generating elements in units of time shorter than a minimum power-on time, the selected element being connected to a first latch of the plurality of latches;

(b) determining whether the calculated power-on time is equal to an integral multiple of the minimum power-on time or not;

(c) if the calculated power-on time is equal to such an integral multiple:

(i) writing the calculated power-on time directly to said first latch as the power-on time for said selected element, and (ii) applying electrical current to the selected element via said first latch for a period equal to said power-on time; and (d) if the calculated power-on time is not equal to such an integral multiple:

(i) determining whether the selected element is an odd-number element or an even-number element;

(ii) changing the calculated power-on time for the selected element to an integral value obtained by rounding up fractions below a decimal point of the calculated power-on time if the selected element is an even-number element, and to an integral value obtained by rounding down fractions below a decimal point of the calculated power-on time if the selected element is an odd-number element;

(iii) writing the changed calculated power-on time directly to said first latch as the power-on time for said selected element; and (iv) applying electrical current to the selected element via said first latch for a period equal to said power-on time.

6. A controlling method according to claim 5, wherein the power-on time is calculated in power-on time units corresponding to half the minimum power-on time.

7. A printing method for a thermal head device, the thermal head device including:

a thermal head having a plurality of heat-generating elements arranged in a row, successive elements of the plurality of heat-generating elements being alternately designated as an odd-number element and an even-number element;

a calculation circuit for generating a power-on time for each heat-generating element of said thermal head;

a plurality of latches, each of the plurality of latches being connected to an associated group of the plurality of heat-generating elements; and a control circuit for controlling said plurality of latches such that each of the plurality of latches applies power to selected elements of the associated group of heat-generating elements for a duration equal the power-on time output from the calculation circuit, wherein said method comprises the steps of:

(a) calculating a power-on time for a selected element of the plurality of heat-generating elements in units of time shorter than a minimum power-on time, the selected element being connected to a first latch of the plurality of latches;

(b) determining whether the calculated power-on time is equal to an integral multiple of the minimum power-on time;

(c) if the calculated power-on time is equal to such an integral multiple:

(i) writing the calculated power-on time directly to said first latch as the power-on time for said selected element, and (ii) applying electrical current to the selected element via said first latch for a period equal to said power-on time; and (d) if the calculated power-on time is not equal to such an integral multiple:

(i) determining whether the selected element is an odd-number element or an even-number element, (ii) changing the calculated power-on time for the selected element to an integral value obtained by rounding up fractions below a decimal point of the calculated power-on time if the selected element is a first one of an odd-numbered element and an even-number element, and to an integral value obtained by rounding down fractions below a decimal point of the calculated power-on time if the selected element is a second one of an odd-number element and an even-number element, (iii) writing the changed calculated power-on time directly to said first latch as the power-on time for said selected element, (iv) applying electrical current to the selected element via said first latch for a period equal to said power-on time, and (v) applying said thermal head to a recording medium.

* * * * *